US005174083A

United States Patent [19]

Mussell

[11] Patent Number: 5,174,083

[45] Date of Patent: Dec. 29, 1992

[54] CONCRETE SLAB FORMING SYSTEM

[76] Inventor: Barry D. Mussell, 155 Charlotte Blvd., Stockbridge, Ga. 30281

[21] Appl. No.: 676,866

[22] Filed: Mar. 28, 1991

[51] Int. Cl.[5] ..... E02D 1/92

[52] U.S. Cl. ..... 52/169.1; 52/699; 52/426; 249/5

[58] Field of Search ..... 52/293, 656, 309.4, 52/309.8, 405, 169.11, 576, 295, 597, 599, 699, 682, 370, 697, 426, 427, 428, 169.1; 249/3, 4, 5, 6, 216

[56] References Cited

U.S. PATENT DOCUMENTS

| | | | |
|---|---|---|---|
| 2,772,468 | 12/1956 | Heltzel | 249/3 X |
| 3,207,465 | 9/1965 | Papin | 249/5 X |
| 4,202,145 | 5/1980 | Coulter et al. | 52/169.1 |
| 4,335,548 | 6/1982 | Rehbein | 52/169.11 |
| 4,413,456 | 11/1983 | Gilb | 52/295 |
| 4,524,553 | 6/1985 | Hacker | 52/169.11 |
| 4,711,058 | 12/1987 | Patton | 52/169.11 |
| 4,739,598 | 4/1988 | Jensen et al. | 52/295 |
| 4,916,879 | 4/1990 | Boeshart | 52/426 |
| 4,938,449 | 7/1990 | Boeshart | 57/699 X |

FOREIGN PATENT DOCUMENTS

| | | | |
|---|---|---|---|
| 121299 | 8/1971 | Norway | 52/169.1 |

*Primary Examiner*—David A. Scherbel
*Assistant Examiner*—Creighton Smith

[57] ABSTRACT

A concrete forming system for the casting of floating slab building foundations with perimeter insulation. Form panels (14A), (14B), (14C), and (14D) comprised of foam core (54) and metal rails (42) and (44), and overlain with stress skins (50), are connected by form tie assemblies (18A), (18B), (18C), and (18D). A protective shield (40) covers the exposed portions of panels (14A) and (14D). Metal stakes (16) anchor formwork assemblies to the earth. System includes embedded anchors (64) and (38). Panel connectors (30) and (32) allow formwork assemblies to be pre-assembled into long lengths, which provides straight and level slab edges and great labor savings. Forming system provides lightweight forming panels, stakes, and lateral bracing which remain in place, providing perimeter insulation and finish exterior surfaces.

23 Claims, 6 Drawing Sheets

CONCRETE SLAB FORMING SYSTEM

BACKGROUND

1. Field of Invention

This invention relates to a system for pouring concrete building slab foundations, wherein the forms used to retain the concrete remain as part of the permanent structure and provide perimeter insulation.

2. Description of Prior Art

Heretofore in the construction of floating concrete building slab foundations, many problems and inefficiencies have been known and recognized.

The most common procedure for constructing a floating slab foundation has been to first dig an upwardly opening trench around the perimeter of the building site and secondly to erect wooden forms in end-to-end fashion, to define the periphery of the building slab. Concrete is then poured into the forms and after it has hardened, the forms are stripped away and either discarded or cleaned and transported to the next site. Perimeter insulation must then be affixed to the slab edge and overlain with a protective shield such as sheet metal or a stucco material.

A list of the tendencies and problems of this and similar procedures is as follows:

(a) Since rather short lengths of forms (approximately ten to sixteen feet) are used, extreme care must be taken as they are staked into position, to ensure their correct location, both laterally and vertically. Any waviness of the forms will result in the building slab being out of dimension and or out of level.

(b) It is difficult to affix insulation to the slab edge. Often insulation is attached to the forms prior to the casting of the concrete, but this often results in the insulation coming off of the slab edge and staying on the forms, when the forms are removed. If the insulation is attached to the hardened concrete after the removal of the forms, it involves expensive and labor intensive procedures.

(c) Various labor intensive means such as re-bar chairs must be employed to hold steel reinforcing in the proper position prior to casting of the concrete.

(d) Special configurations such as brick ledges and stem walls are particularly difficult, labor intensive, and prone to error.

(e) An unnecessary excess of concrete is often required because the interior vertical side of the footing trench tends to cave off because of sandy or unstable earth.

(f) Placement, removal, and transportation of forms results in significant costs in both labor and material.

(g) Embedded fasteners such as mudsill anchors, have to be held in correct alignment by:

(1) site constructed templates (2) fastening to the forms, which makes removal of forms difficult.

(3) manually setting them into the plastic concrete, which is both inaccurate and labor intensive.

There have been a number of inventions which have addressed some of the aforementioned problems encountered in the forming of concrete building slabs. They are as follows:

(1) U.S. Pat. No. 4,202,145 Coulter et al (1980) provides for a metal leave-in-place form with internal stakes. This system offers some advantage, but makes no provision for perimeter insulation and is too elaborate to be economically feasible.

(2) U.S. Pat. No. 4,335,548 Rehbein (1982) provides for an insulating lost formwork panel with a protective sheath, but is without readily workable means for staking the panels into position or connecting panels end-to-end.

(3) U.S. Pat. No. 4,524,553 Hacker (1985) provides for a thermal insulating girdle with protective sheath and mudsill anchors, but has a number of disadvantages, which are:

(a) It is held in position by conventional wooden stakes which must be subsequently removed.

(b) Stakes and mudsill anchors which extend upward from the slab surface, interfere with screeding operations while casting the concrete slab.

(c) The insulated girdle is too short in its vertical dimension, and is without means to secure the additional insulating panel which is positioned below it.

(d) The embedded tie means with rebar supports, positions the rebar high in the concrete footing, rather than in the lower portion where it achieves its greatest potential as reinforcement.

(4) U.S. Pat. No. 4,711,058 Patton (1987) provides for a form comprised of a foam core and protective sheath but has the following disadvantages:

(a) The spring clip employed for securing the panel to wooden stakes has proven to be ineffective and after this panel was made commercially available, it was simply nailed to the wooden stakes. This practice leaves holes and blemishes in the finish exterior surface.

(b) Because the protective sheath only partly encases the foam core, the form panel must be made from high density and therefore high cost foam in order to achieve sufficient rigidity.

In summary, many of the drawbacks listed above in the traditional process of constructing concrete building slabs are not sufficiently addressed by the prior art, nor the traditional methodology.

OBJECTS AND ADVANTAGES

It is the object of the present invention to overcome the shortcomings of the prior art and the more traditional methods and to provide a simple, lightweight, and cost efficient forming system for the casting of floating slab building foundations.

The present invention obtains many advantages over the prior art by the novel use of an interior footing form panel. This interior lost formwork panel is a crucial element in obtaining the objects and advantages of the present invention. Several objects and advantages are:

(1) A system whose design and rigidity permit individual panels to be pre-assembled into long lengths (approximately 40 feet) prior to being placed and staked into position in the footing trench, thereby increasing both the speed and accuracy of the installation.

(2) A system which eliminates entirely the need to remove either the forms or stakes after the casting of the concrete.

(3) A system which eliminates the need for "kickers" (braces) to provide lateral support for the forms, and due to its unitary construction, allows lightweight easily driven metal stakes to be used.

(4) A system which allows the perimeter insulation and its finish surfaces to serve as the form panel and remain in place after the concrete is cast as a permanent thermal barrier and exterior finish surface.

(5) A system which provides internal integral supports to position reinforcing steel in the optimum position in the concrete footing.

(6) A system capable of forming complex configurations such as brick ledges and stem walls as easily and accurately as in a standard installation of a floating slab with a single vertical side face.

(7) A system with an interior vertical lost formwork panel to define the interior vertical face of the footing trench, and preclude the wasteful use of excess concrete due to a sloped earthen face as in the prior art. In some installations, the dollar savings of the elimination of this excess concrete, will equal the entire material costs of the present invention.

(8) A system which has a smooth top screed rail which facilitates the accurate placing and screeding of the concrete slab.

(9) A system which allows the easy and accurate placing of embedded fasteners, both for the placement of anchor bolts and the like which are embedded some distance from the outside vertical slab edge, and also the placement of strap type mudsill anchors which can be snappably engaged into the top screed rail at the exterior vertical slab edge.

The foregoing may be summarized into three primary objectives:

(1) Save labor (2) Save material (3) Improve quality and consistency of the finished product.

Further objects and advantages of the present invention will become apparent from a consideration of the drawings and the ensuing description of it.

DRAWING FIGURES

REFERENCE NUMERALS IN DRAWINGS

Figure 1:
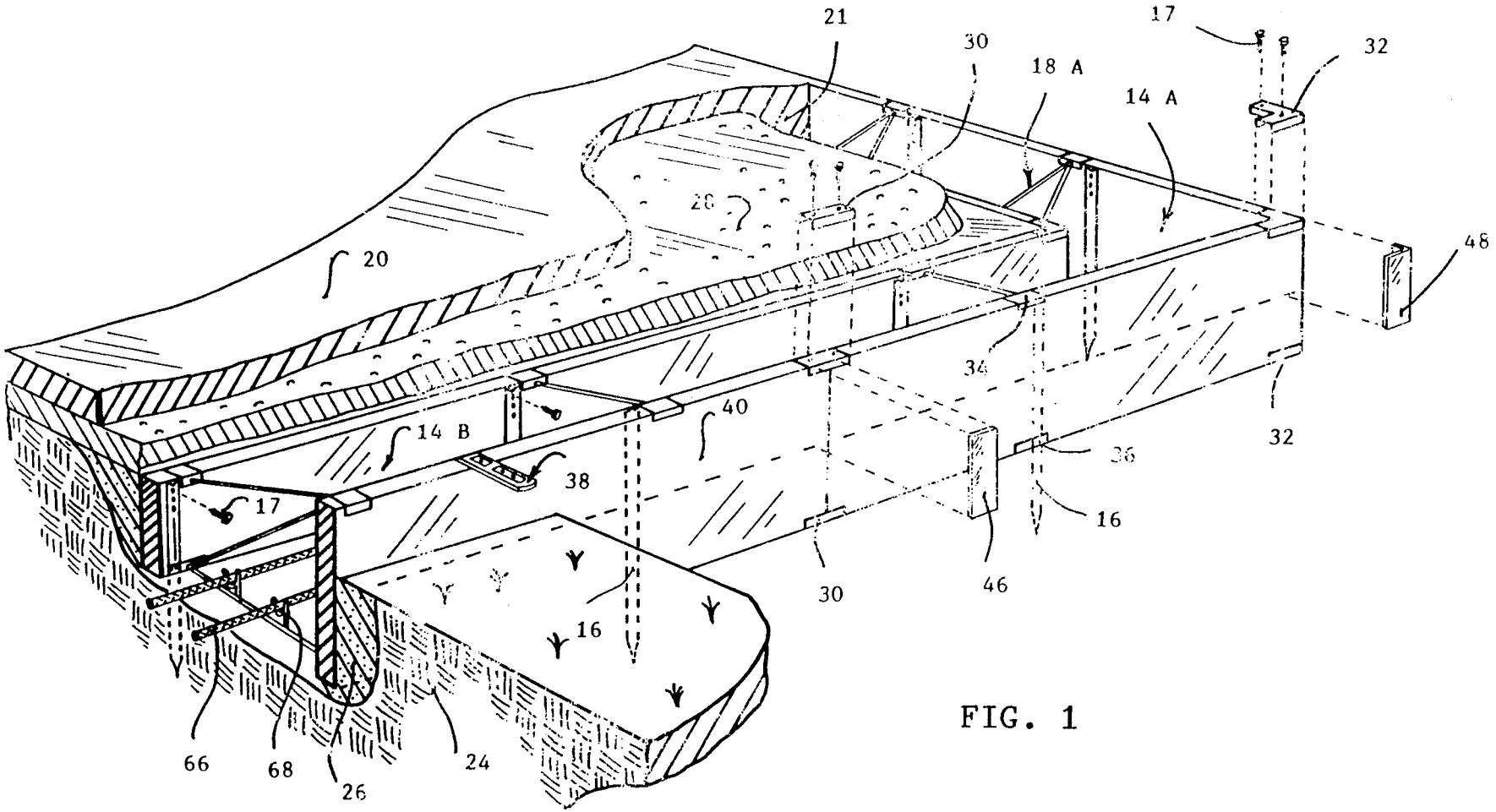
FIG. 1 is a perspective view of the most commonly used embodiment, that of a slab with a single vertical exterior face.

14A: Exterior form panel
14B: Interior form panel
14C: Brick ledge form panel
14D: Slab step form panel
16: Metal stake
17: Sheet metal screw
18A: Form tie assembly
18B: Slab step/brick ledge form tie assembly
18C: Stem wall form tie assembly
18D: Single form. form tie assembly
19: Wire
20: Slab
21: Footing
22: Brick
24: Unexcavated earth
25: Concrete stem wall
26: Earthen fill
28: Gravel bed
30: Panel joint connector
32: Panel corner joint connector
34: Upper bracket
36: Lower bracket
37: Single form bracket
38: Mudsill anchor
40: Protective shield
42: Bottom metal rail
44: Top metal rail
46: Joint cover
48: Corner joint cover
50: Stress skin
52: Bracket tabs
54: Foam core
56: Stake slot
58: Nail
60: Mudsill anchor tab
61: Mudsill attachment arm
62: Mudsill anchor retaining clip
64: Anchor bolt
65: Anchor bolt template
66: Rebar
67: Anchor bolt template bracket
68: Rebar stirrup
70: Mudsill

DESCRIPTION OF INVENTION

A typical embodiment of the present invention is illustrated in FIG. 1, a perspective view of my forming system. An exterior panel 14A is connected to an interior form panel 14B, by a form tie assembly 18A. These connected panels are positioned in a trench in unexcavated earth 24. Earthen fill 26 fills voids between panels and unexcavated earth 24. A metal stake 16 engages form tie assembly 18A, and penetrates unexcavated earth 24. A sheet metal screw 17, fastens metal stake 16 to form panels. A panel joint connector 30 joins a plurality of panels in end-to-end relation, thereby forming a unitary longitudinal form member. A panel corner joint connector 32 joins panels at 90° intersections. Connectors 30 and 32 are fastened to panels 14A and 14B by sheet metal screws 17. A protective shield 40 is adhesively laminated on exterior form panel 14A. A joint cover 46 covers butt joints in protective shield 40. A corner joint cover 48 covers corner joints of protective shield 40. A gravel bed 28 normally 4 inches thick, is laid up to the vertical plane formed by interior form panel 14B. Form tie assembly 18A includes a rebar stirrup 68, which positions a rebar 66 in correct alignment in a concrete footing 21. A mudsill anchor 38 is snapped into position on exterior form panel 14A. A concrete slab 20 is cast over gravel bed 28 and into void formed between exterior form panel 14A and interior form panel 14B.

Figure 2:
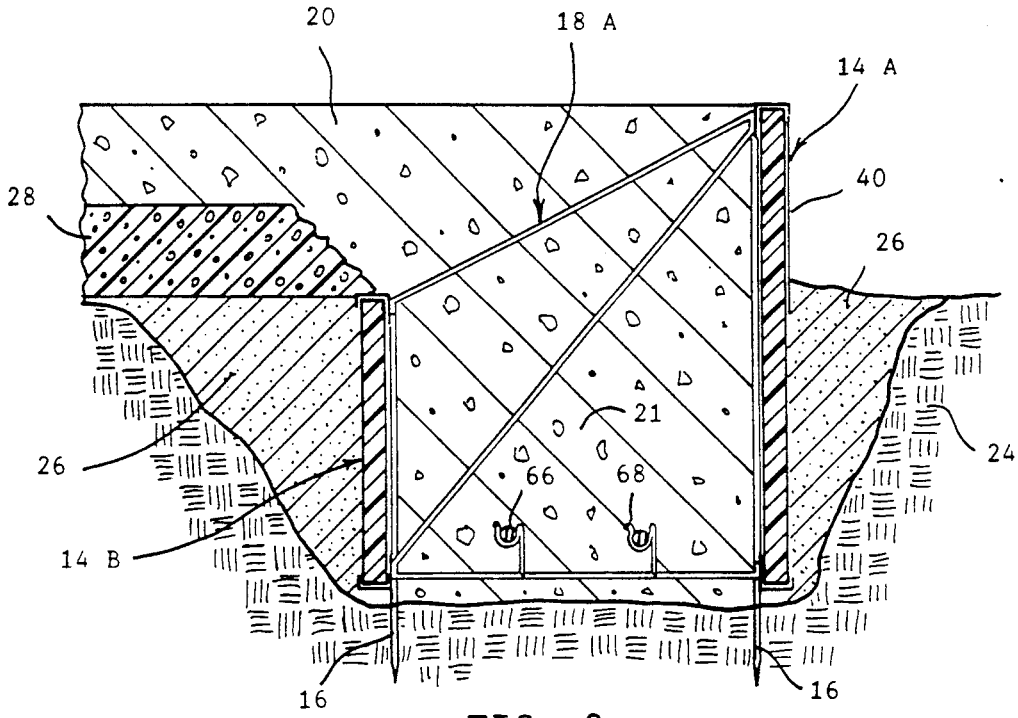
FIG. 2 is a vertical cross sectional view of the embodiment shown in FIG. 1.

FIG. 2 illustrates the embodiment used for the pouring and insulating of basic floating building slab constructions, and is the type shown in FIG. 1. Note that metal stakes 16 are encased by concrete and do not have to be removed. Protective shield 40 is not penetrated or marred by any fasteners or stakes, and form the finish exterior surface. Interior form panel 14B retains earthen fill 26. This saves the use of excess concrete equal to the volume of earthen fill 26. Exterior form panel 14A is of sufficient vertical dimension to extend downward to unexcavated earth 24, so that earthen fill 26 may fill the void between them and preclude the concrete from footing 21 from protruding under form panel 14A and into the void filled by earthen fill 26, as is the case in form boards in the prior art, which are of insufficient height. This results in additional saved material costs.

Figure 3:
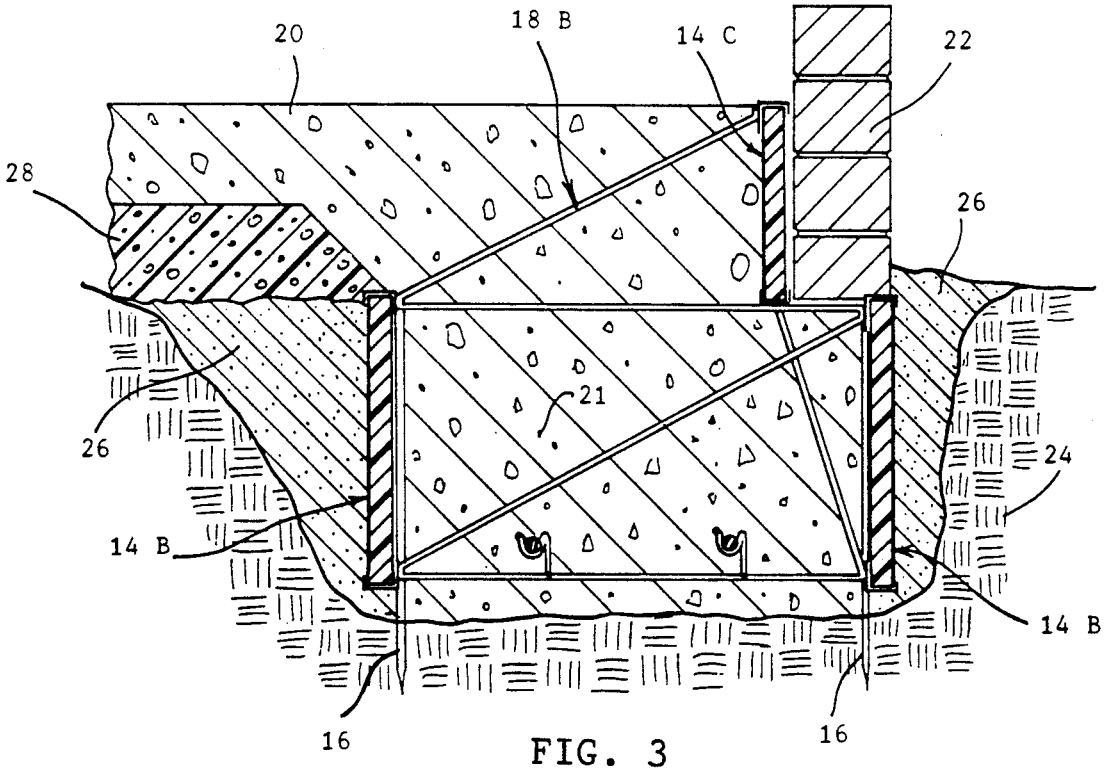
FIG. 3 is a vertical cross sectional view of slab edge with support ledge for brick veneer.

FIG. 3 illustrates an embodiment intended for use in forming floating building slabs with a support ledge for brick veneer. Two form panels are used in place of form panel 14A in FIG. 1. A brick ledge form panel 14C forms top portion of slab 20 and form panel 14B forms lower portion below the brick ledge. A form tie assembly 18B is used to connect interior and exterior panels and provide rebar supports.

Figure 4:
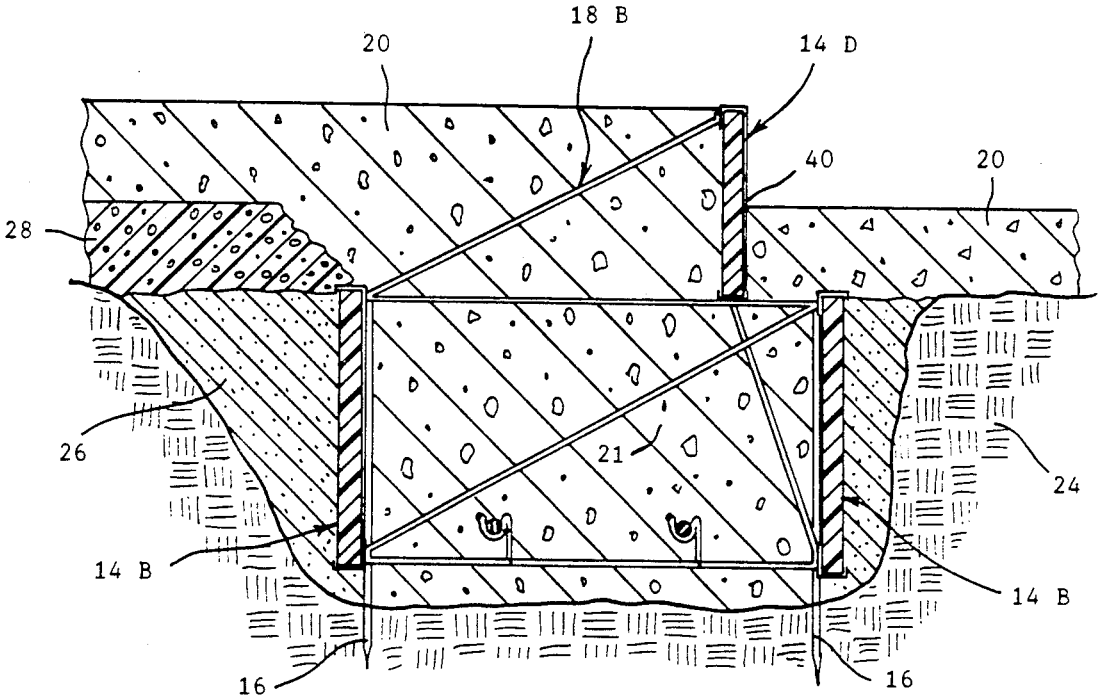
FIG. 4 is a vertical cross sectional view of slab edge with slab elevation change.

FIG. 4 illustrates an embodiment intended for use in forming a building slab and footing with a change in the elevation of the slab, such as is common in residential applications where a garage or porch slab must be lower in elevation than the dwelling area slab. A slab step panel 14D with protective shield 40 is used to form the top portion of slab 20. Protective shield 40 provides a finish exterior surface. A form tie assembly 18B is used to connect form panels 14B and 14D and provide rebar supports.

Figure 5:
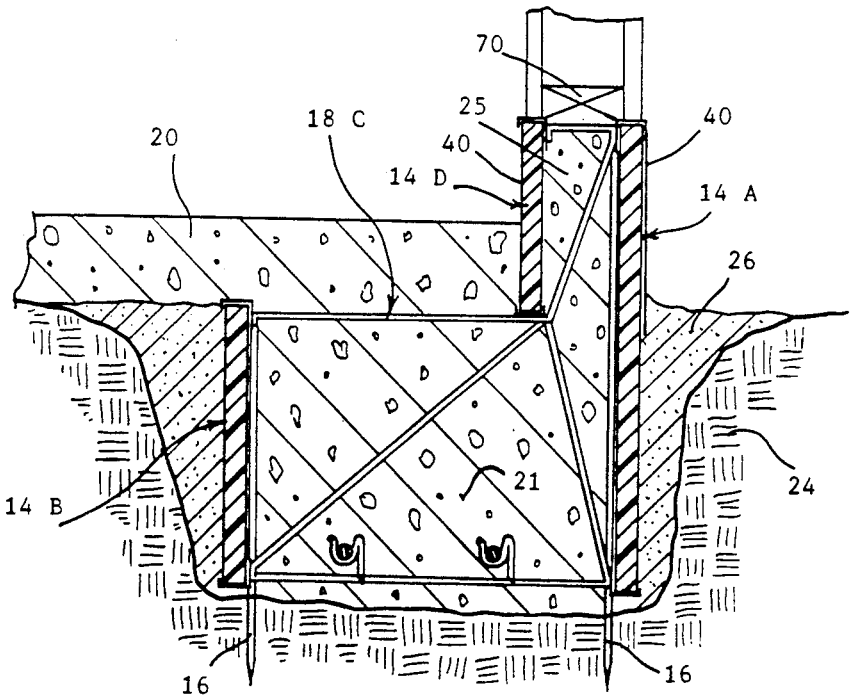
FIG. 5 is a vertical cross sectional view of slab edge with integral concrete stem wall.
Figure 10:
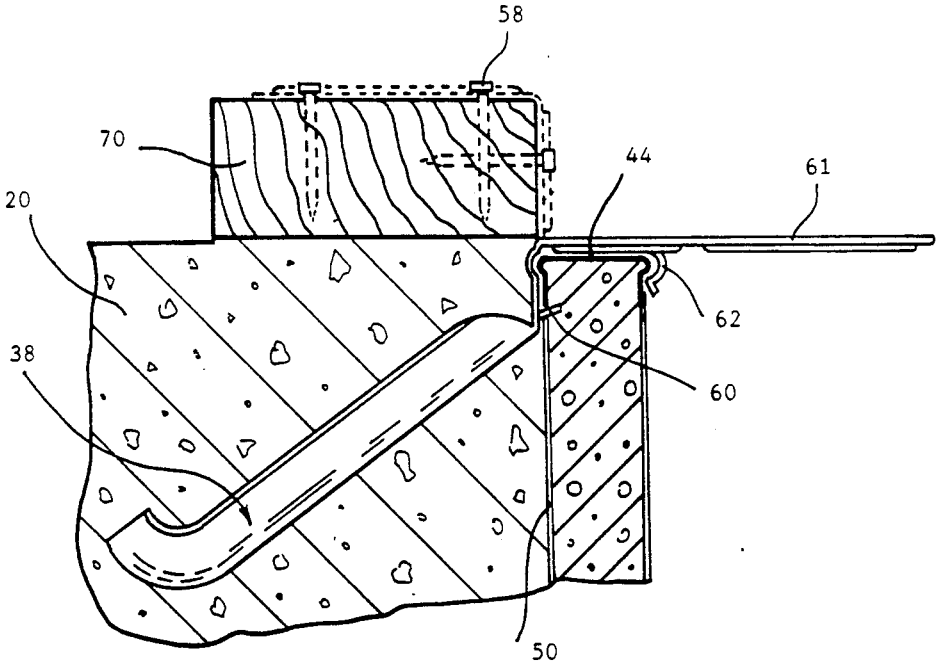
FIG. 10 is a vertical cross sectional view of a mudsill anchor and its attachment.

FIG. 5 illustrates an embodiment intended for use in forming a building slab with an integral concrete stem wall, such as is common for the support of garage walls in residential applications. Slab step panel assembly 14D in cooperation with exterior form panel 14A, defines a void wherein a concrete stem wall 25 is cast. Protective shield 40 provides finish surfaces for the interior and exterior of concrete stem wall 25. A stem wall form tie assembly 18C connects panels 14A, 14B, and 14D and provides rebar stirrup 68 to position rebar 66 in concrete footing 21. A mudsill anchor 70 is attached to concrete stem wall 25 as shown in FIG. 10.

Figure 6:
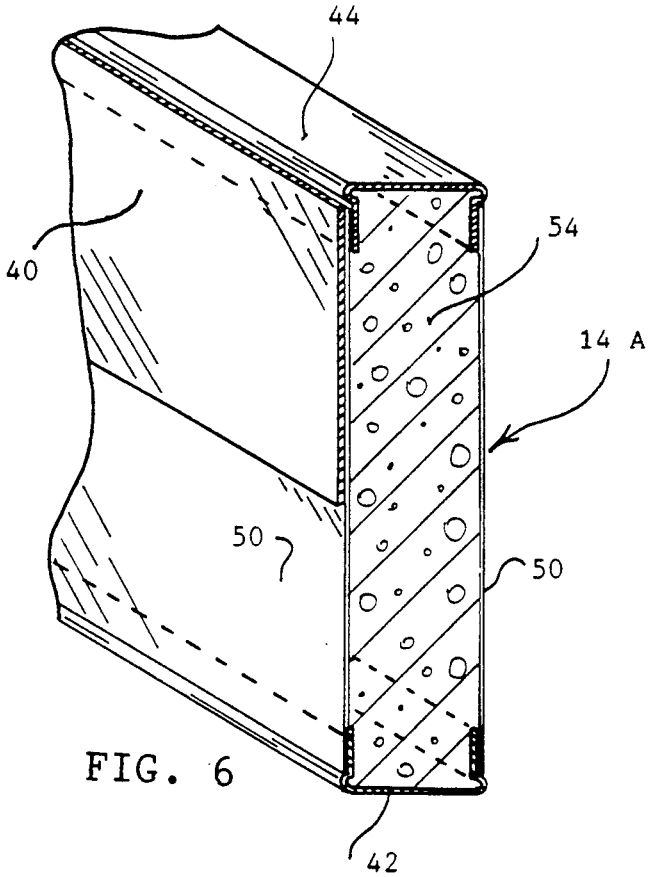
FIG. 6 is a perspective view of one exterior form panel.

FIG. 6 illustrates a cross section of exterior form panel 14A, which is formed of a foam core 54 of lightweight insulating material such as expanded or extruded polystyrene foam with a density of between 16 and 32 KG per cubic meter (1 to 2 lbs. per cubic foot). A top metal rail 44 encases the top linear edge of foam core 54, providing a screed rail. A bottom metal rail 42 encases the bottom linear edge of foam core 54. Metal rails 42 and 44 are formed of sheet metal. A stress skin 50 is laminated with suitable adhesive on the outer planar surface of foam core 54 and leg portions of metal rails 42 and 44. Any suitable sheet material may be employed for stress skin 50, such as a waxed or resin stiffened paper or paperboard. Protective shield 40 is laminated, with suitable adhesive, on one planar surface of foam core 54. Protective shield 40 may be of any suitable water and impact resistant material, such as PVC plastic or fiberglass. Metal rails 42 and 44 are configured to enable form tie assemblies 18A, 18B, 18C, and 18D to be snappably connected to metal rails 42 and 44 as shown in FIGS. 2, 3, 4, 5, and 12 and as evident from bracket details in FIGS. 8, 9.

Figure 7:
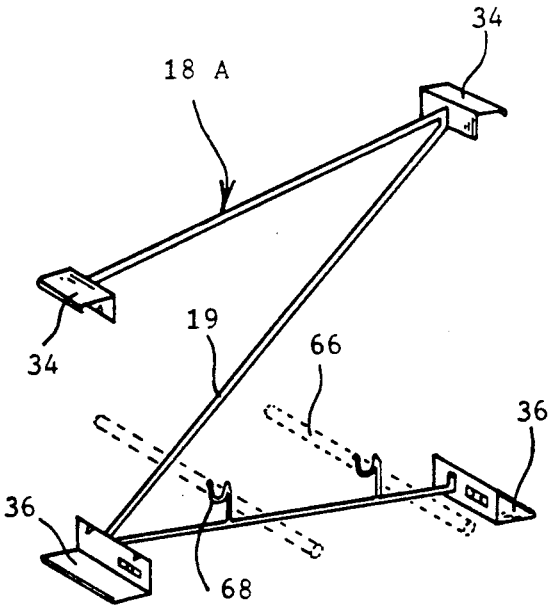
FIG. 7 is a perspective view of one form tie assembly.

FIG. 7 shows a perspective view of form tie assembly 18A. A wire 19 is formed into a configuration to space, connect, and brace form panels 14A and 14B. An upper bracket 34 is metal and welded to wire 19. A lower bracket 36 is metal and welded to wire 19. Wire 19 is bent to form rebar stirrups 68, which hold rebar 66 in correct alignment.

Figure 8:
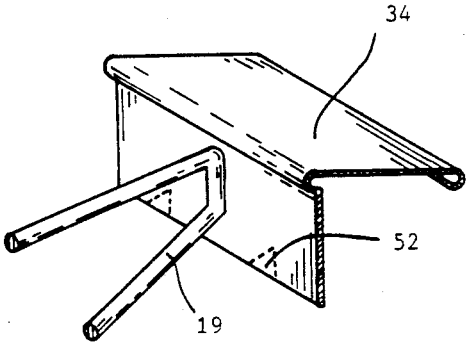
FIG. 8 is a perspective view of upper bracket used on form tie assemblies.

FIG. 8 is a perspective view of upper bracket 34. It shows how upper bracket 34 is configured to be snappably engaged with metal rail 44, as shown in FIG. 6. A bracket tab 52 pierces stress skin 50 and engages one vertical leg of metal rail 44.

Figure 9:
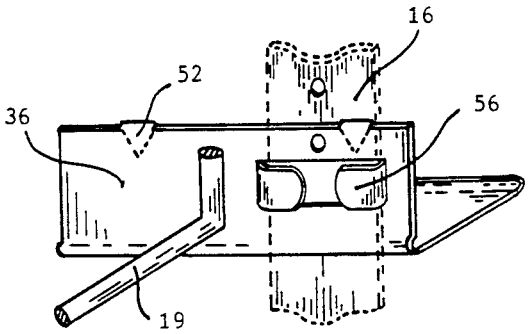
FIG. 9 is a perspective view of lower bracket used on the form tie assemblies.

FIG. 9 is a perspective view of a lower bracket 36 showing the welded attachment of wire 19. Lower bracket 36 engages metal rail 42 in like fashion as upper bracket 34 does with metal rail 44. Lower bracket 36 is made of stamped metal and has a stake slot 56 formed therein to slidably receive and retain metal stake 16.

FIG. 10 illustrates the attachment and operation of mudsill anchor 38. Mudsill anchor 38, stamped from sheet metal forms an anchoring device for securely attaching wooden mudsills to concrete building slabs. A mudsill anchor tab 60, stamped out of sheet metal of mudsill anchor 38, pierces stress skin 50 and engages one vertical leg of top metal rail 44. A mudsill anchor retaining clip 62, stamped out of sheet metal of mudsill anchor 38, snappably enagages metal rail 44. A mudsill attachment arm 61 connects and anchors mudsill 70 to concrete slab 20. A nail 58 attaches mudsill attachment arm 61 to wooden mudsill 70.

Figure 11:
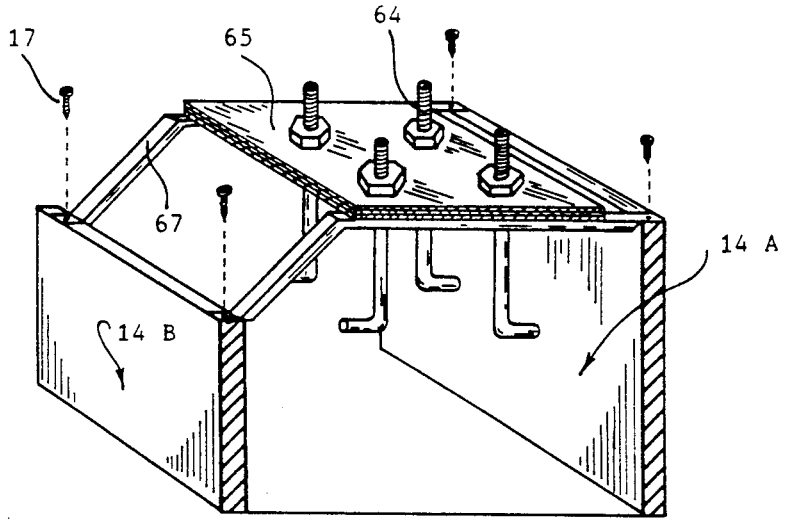
FIG. 11 is a perspective view of anchor bolt template brackets and illustrates their use.

FIG. 11 is a perspective view of a cross section of a form unit as shown in FIG. 2. It illustrates how an anchor bolt template bracket 67 spans between form panels 14A and 14B and is attached to metal edges 44 by sheet metal screws 17. An anchor bolt 64 is held in correct position by being placed in holes in an anchor bolt template 65, which is attached to anchor bolt template bracket 67 by sheet metal screws 17.

Figure 12:
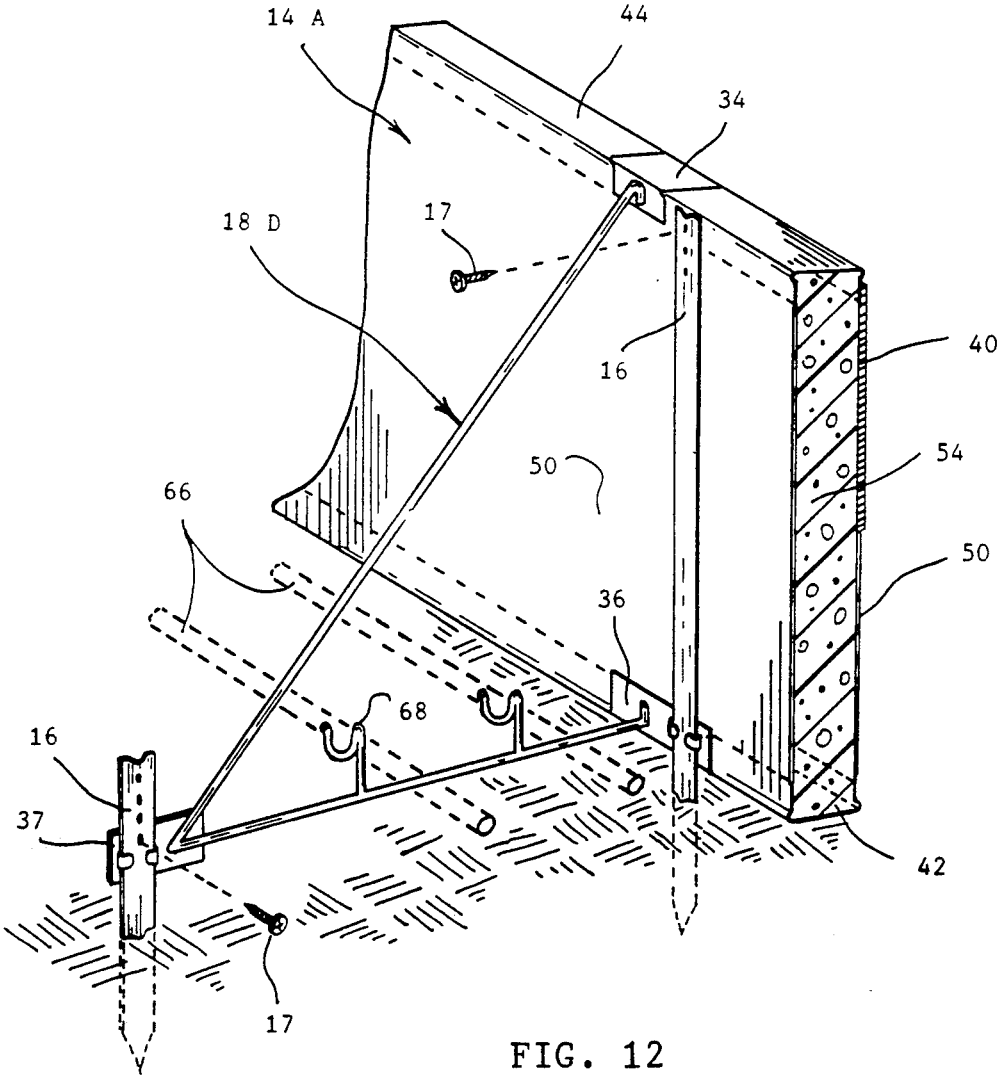
FIG. 12 is a perspective view of a single form panel system and its bracing and staking adjuncts.

FIG. 12 is a perspective view of an exterior form panel 14A being used alone. It illustrates how a wire form tie assembly 18D attaches to metal rails 42 and 44 of form panel 14A. Metal stakes 16 engage stake slot 56 in bracket 36 and a single form bracket 37 to secure form tie assembly 18D to the earth. Sheet metal screws 17 attaches metal stakes 16 to single form bracket 37 and metal rail 44. Form tie assembly 18D includes rebar stirrups 68 to support rebars 66. This embodiment would be used in mild climates where the frost line is shallow and therefore the footing is not required to be as deep, as this situation results in the earthen inner face of the footing being shorter and less prone to cave off into the footing.

OPERATION OF INVENTION

The static structure of the present invention has been herein disclosed. It is now followed by a description of the operation and assembly of the forming system as shown in FIGS. 1 and 2.

First an upwardly opening trench is excavated around the perimeter of the building slab location to accommodate a footing. A suitable level working surface is selected for the preassembly of the formwork components. A sidewalk or a road pavement are examples of suitable surfaces. A chalk line is then placed upon such working surface to provide a straight edge. A plurality of form panels 14A are then laid down flat upon such surface in end-to-end fashion. Metal rail 42 or 44 is aligned with the chalk line or straight edge, and panel joint connectors 30 are snapped onto metal rails 42 and 44. Sheet metal screws 17 attach connectors 30 as shown in FIG. 1, thereby forming a unitary longitudinal form member. The same procedure as employed for panels 14A are now repeated for panels 14B. Form tie assemblies 18A are now snapped onto metal rails 42 and 44 of form panels 14A at approximately 3 foot intervals along the length of assembled plurality of panels 14A. Form tie assemblies 18A are now snapped onto metal rails 42 and 44 of assembled plurality of panels 14B. You now have a unitary formwork assembly, which is substancially rigid and capable of being lifted by each end and set into the footing trench. Such assembly can span a distance of approximately 40 feet without sagging, due to its light weight, the tensile strength of metal rails 42 and 44, and the bracing strength of stress skin 50 on foam core 54.

After the assembly is set into the footing trench, each end is positioned correctly, both in its elevation and lateral alignment with the building perimeter. Metal stakes are then inserted into stake slot 56 of lower bracket 36 and driven into unexcavated earth 24. Metal stake 16 is driven down so its top is level with top rail 44 and adjacent to the end of upper bracket 34 as shown in FIG. 12. Sheet metal screw 17 is then installed through metal stake 16 into the vertical leg of top metal rail 44. With each end of the unitary formwork assembly now having been staked into correct position, the entire length of the assembly is in correct position. A plurality of metal stakes 16 can now be rapidly driven and secured at each form tie assembly 18A along the length of the formwork assembly. These metal stakes 16, due to their slender cross section can be driven with a small hammer rather than a large sledge hammer, as is required with wooden stakes of rather thick cross section. They also drive straighter and are not as affected by hard or rocky soil as are wooden stakes. These metal stakes are presently available commercially, and are comparable in cost to the use of wooden stakes but have the advantage of being prefabricated, whereas wooden stakes must be cut, normally on site. By assembling formwork in long rigid lengths a great deal of labor is saved in that fewer "shots" with a builders level are required to position the formwork correctly.

The foregoing procedure is repeated as required to encircle the building perimeter. Any cutting of the form panels to length may be easily accomplished with a hack saw and utility knife. Corner connections are made by securing corner joint connectors 32 with metal screws 17. Joints in protective shield 40 are covered by gluing, with appropriate adhesive, joint covers 46 and corner joint covers 48 into position as shown in FIG. 1. Once all formwork is properly positioned and staked, the voids between form panels 14A, 14B and the footing trench are filled with earthen fill 26 as shown in FIG. 2. Although the formwork is already stable, this fill stabilizes it further.

Gravel bed 28 is now placed into position and graded to the correct level. Reinforcing steel 66 can now be placed into rebar stirrups 68. Vapor barriers and or wire mesh reinforcement is now placed over gravel bed 28. Mudsill anchors 38 may be snapped onto top metal rail 44 of form panels 14A at any desired location as shown in FIG. 10. Anchor bolts 64 can be easily and accurately positioned as shown in FIG. 11. Concrete slab 20 is then cast over gravel bed 28 and into footing 21 to the top of form panel 14A encasing stakes 16, form tie assemblies 18A, rebar 66, and anchors 38 and or 64. After concrete is hardened, mudsills 70 are positioned on slab 20 and mudsill anchor attachment arm 61 is bent around mudsill 70 and fastened with nails 58 as shown in FIG. 10.

The procedure for the assembly and installation of formwork as shown in FIGS. 3, 4, 5, is the same as for the formwork of FIG. 2 as described above, except that the form panels 14C and 14D are not snapped onto form tie assemblies 18B and 18C until after formwork assemblies are staked into position in the footing trench. This ensures adequate access for the placement and securing of metal stakes 16.

From the operational description above, it becomes evident that the present invention accomplishes its three primary objectives:

(1) Saves labor by:
- (a) lightweight forms
- (b) rapid pre-assembly
- (c) no cutting of stakes
- (d) easily driven metal stakes
- (e) no removal of forms or stakes
- (f) no separate placing of perimeter insulation
- (g) no separate placing of cover or exterior finish for perimeter insulation
- (h) no clean-up and transportation of reusable forms
- (i) no stakes or "kickers" required for lateral support of forms
- (j) no separate placing of rebar chairs or supports
- (k) rapid and accurate placing of embedded anchors
- (l) no vertical projections above the slab surface to interfere with screeding operations (2) Saves material by:
- (a) eliminating a substantial amount of excess concrete
- (b) eliminating the use of wooden stakes
- (c) eliminating the use of wooden forms (3) Improves the quality of finished product by:
- (a) providing straight rigid forms, which result in straight level slabs.
- (b) yielding flatter slab surface because screeding operations are not interrupted by upward projecting stakes.
- (c) providing perimeter insulation which is continuous, unbroken, and extends to the bottom of the footing trench.
- (d) providing smooth finish exterior surface on all exposed concrete surfaces.
- (e) ensuring accurate alignment of embedded anchors.

Although the description above contains many specificities these should not be construed as limiting the scope of the invention but as merely providing illustrations of some of the presently preferred embodiments of the invention. For example many other more specialized slab edge profiles may be formed by the application of this invention. Thus the scope of the invention should be determined by the appended claims and their legal equivalents, rather than by the examples given.

I claim:

1. A forming system for building slab foundations including integral footing comprising:
- (a) a plurality of horizontally elongate generally vertical planar first panels forming an outer periphery of said building slab foundation and integral footing;
- (b) a plurality of horizontally elongate generally vertical planar second panels forming an inner face of said integral footing, said second panels having a lesser vertical dimension than said first panels;
- (c) connection means for coupling said first panels and said second panels, whereby no external bracing is required for lateral support of said first panels forming the outer periphery of said building slab foundation and integral footing.

2. The forming system of claim 1 further including staking means disposed interior of said outer periphery of said building slab foundation, said staking means cooperating with said connection means to secure said first panels and said second panels to a body of earth whereby no removal of stakes subsequent to the casting of said building slab is required.

3. The forming system of claim 2 wherein said connection means further includes a brace extending from a top linear edge of said first panel to a bottom linear edge of said second panel and further including an integral rebar stirrup, whereby reinforcing steel may be positioned in a lower portion of said integral footing.

4. The forming system of claim 2 further including a substantially rigid longitudinal rail affixed to a top linear edge and a bottom linear edge of said first panels and said second panels.

5. The forming system of claim 4 further including a plurality of panel joint connectors, said connectors coupling said longitudinal rails in generally end-to-end fashion, said first panels being coupled to form a unitary longitudinal first form member, and said second panels being coupled to form a unitary longitudinal second form member, thereby enabling said first panels and said second panels to be pre-assembled prior to being placed into a trench for said integral footing.

6. The forming system of claim 4 wherein said connection means are comprised of welded wire configurations and a plurality of stamped sheet metal brackets and are configured to snappably engage said longitudinal rail.

7. The forming system of claim 6 further including a plurality of mudsill anchors, said mudsill anchors being configured to snappably engage said longitudinal rail, thereby being held in secure alignment for casting of concrete around them.

8. The forming system of claim 4 wherein said first panels are comprised of an insulated panel having an inner planar surface and an outer planar surface.

9. The forming system of claim 8 further including a sheet material adhesively laminated upon said inner surface and said outer surface of said insulated panels.

10. The forming system of claim 8 further including a protective shield adhesively laminated upon said outer surface of said insulated panel.

11. The forming system of claim 8 wherein said insulated panel is comprised of polystyrene foam.

12. The forming system of claim 2 further including a plurality of horizontally elongate generally vertical planar third panels disposed interior of and in generally parallel relationship with said first panels, said third panels having their bottom surfaces planar with the top surface of said first panels, said third panels connected to said first panels and said second panels by said connection means, thereby forming an integral brick ledge.

13. The forming system of claim 2 further including a plurality of horizontally elongate generally vertical planar fourth panels disposed interior of and in generally parallel relationship with said first panels, said fourth panels having their top surface planar with the top surface of said first panels, said fourth panels connected to said first panels and said second panels by said connection means, thereby forming an integral concrete stem wall.

14. A forming system for concrete slabs comprising:

(a) an insulating panel of substantially rigid foam in linear form having a generally rectangular shape, said panel having an outer surface, an inner surface, a top edge, and a bottom edge;

(b) a plurality of substantially rigid longitudinal rails affixed to said top edge and said bottom edge of said insulating panel;

(c) staking means disposed interior of said inner surface of said insulating panel for securing said insulating panel to a body of earth;

(d) bracing means disposed interior of said inner surface of said insulating panel for securing said insulating panel to the earth, therein providing lateral support for said insulating panel;

(e) connection means for coupling a plurality of said insulating panels in a generally end-to-end fashion, thereby forming a substantially rigid unitary longitudinal form member to retain concrete poured into a slab floor configuration becoming an integral part of the periphery thereof.

15. The forming system of claim 14 wherein said insulating panels are comprised of polystyrene foam, and said longitudinal rails are comprised of sheet metal channels in a generally u-shaped configuration, said channels being contiguous with and encasing said top edge and said bottom edge of said insulating panel.

16. The forming system of claim 14 wherein said insulating panels have adhesively laminated upon said outer surface and said inner surface a sheet material.

17. The forming system of claim 16 wherein said sheet material is comprised of a paper material coated with a substance selected from the group consisting of paraffin, oil, resin, and plastic.

18. The forming system of claim 14 further including a protective shield adhesively laminated upon said outer surface of said insulating panel.

19. The forming system of claim 18 wherein said protective shield is selected from the group consisting of metal, plastic, and fiberglass.

20. The forming system of claim 19 wherein said protective shield is of PVC plastic.

21. The forming system of claim 14 wherein said bracing means are comprised of welded wire and a plurality of stamped sheet metal brackets, said bracing means including integral rebar stirrups, whereby reinforcing steel may be positioned in a lower portion of said concrete slab.

22. The forming system of claim 21 wherein said bracing means are configured to snappably engage said plurality of substantially rigid longitudinal rails.

23. The forming system of claim 22 further including a plurality of mudsill anchors, said mudsill anchors being configured to snappably engage the longitudinal rail affixed to said top edge of said insulating panel.

* * * * *

UNITED STATES PATENT AND TRADEMARK OFFICE

CERTIFICATE OF CORRECTION

PATENT NO. : 5,174,083

DATED : Dec. 29, 1992

INVENTOR(S) : Barry D. Mussell

It is certified that error appears in the above-indentified patent and that said Letters Patent is hereby corrected as shown below:

Column 9, Line 8, delete "the" .

Drawing figure 1 needs to be replaced with a clear copy. The reference numerals are unclear. The same figure appears on the patent face page.

Signed and Sealed this

Second Day of November, 1993

*Attest:*

Bruce Lehman

BRUCE LEHMAN

*Attesting Officer*

*Commissioner of Patents and Trademarks*